US010327315B2

(12) United States Patent
Kurihara

(10) Patent No.: US 10,327,315 B2
(45) **Date of Patent: *Jun. 18, 2019**

(54) LIGHTING APPARATUS AND LIGHTING SYSTEM SUPPORTING A MESH NETWORK

(71) Applicant: Panasonic Intellectual Property Management Co., Ltd., Osaka (JP)

(72) Inventor: Shinichiro Kurihara, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/161,810

(22) Filed: Oct. 16, 2018

(65) Prior Publication Data

US 2019/0053358 A1 Feb. 14, 2019

Related U.S. Application Data

(63) Continuation of application No. 15/401,268, filed on Jan. 9, 2017, now Pat. No. 10,136,505.

(30) Foreign Application Priority Data

Jan. 12, 2016 (JP) ..... 2016-003942

(51) Int. Cl.
*H05B 37/02* (2006.01)
*H05B 33/08* (2006.01)

(52) U.S. Cl.
CPC ..... *H05B 37/0272* (2013.01); *H05B 33/0845* (2013.01); *H05B 33/0863* (2013.01)

(58) Field of Classification Search
CPC ..... H05B 37/0272; H05B 33/0845; H05B 33/0863
USPC ..... 315/307
See application file for complete search history.

(56) References Cited

U.S. PATENT DOCUMENTS

2006/0044152 A1 3/2006 Wang
2010/0281175 A1 11/2010 Shinomiya et al.
2012/0098445 A1* 4/2012 Park ..... H05B 37/0272 315/193

(Continued)

FOREIGN PATENT DOCUMENTS

EP 2503856 A2 9/2012
JP 2003-018666 A 1/2003

(Continued)

OTHER PUBLICATIONS

Allowed Claims for U.S. Appl. No. 15/401,268.

*Primary Examiner* — Dylan C White
(74) *Attorney, Agent, or Firm* — Renner, Otto, Boisselle & Sklar, LLP

(57) ABSTRACT

A lighting apparatus includes an apparatus communicator and an apparatus controller. The apparatus communicator wirelessly transmits and receives information on operations of the lighting apparatuses. The apparatus controller interprets: a mesh profile which is a communications protocol for the lighting apparatus to transmit and receive the information to and from another lighting apparatus and a communication terminal forming a mesh network, and a user profile which is a communications protocol for the lighting apparatus and the communication terminal to communicate with each other, the user profile being set depending the communication terminal.

4 Claims, 7 Drawing Sheets

(56) References Cited

U.S. PATENT DOCUMENTS

| | | | | |
|---|---|---|---|---|
| 2013/0063042 | A1* | 3/2013 | Bora | H05B 33/0863 315/292 |
| 2013/0285576 | A1 | 10/2013 | Van Der Zande et al. | |
| 2014/0125451 | A1 | 5/2014 | Sako et al. | |
| 2015/0123546 | A1 | 5/2015 | Pandharipande et al. | |
| 2016/0066390 | A1 | 3/2016 | Van Der Zande et al. | |
| 2016/0323972 | A1* | 11/2016 | Bora | H05B 33/0842 |
| 2017/0094742 | A1 | 3/2017 | Nakamura | |
| 2017/0098354 | A1* | 4/2017 | Loeb | H04W 4/70 |
| 2017/0142810 | A1* | 5/2017 | Cho | H05B 37/0272 |
| 2017/0202076 | A1* | 7/2017 | Kurihara | H05B 33/0845 |
| 2017/0277147 | A1 | 9/2017 | De Vaan | |
| 2017/0364348 | A1 | 12/2017 | Klitenik | |
| 2018/0115435 | A1 | 4/2018 | George | |

FOREIGN PATENT DOCUMENTS

| | | | |
|---|---|---|---|
| JP | 2005-538506 | A | 12/2005 |
| JP | 2009-055370 | A | 3/2009 |
| JP | 2013-544420 | A | 12/2013 |
| JP | 2014-060078 | A | 4/2014 |
| JP | 2014-093204 | A | 5/2014 |
| JP | 5740512 | B1 | 5/2015 |
| JP | 2015-519694 | A | 7/2015 |

* cited by examiner

LIGHTING APPARATUS AND LIGHTING SYSTEM SUPPORTING A MESH NETWORK

CROSS REFERENCE TO RELATED APPLICATION

This application is a continuation of U.S. patent application Ser. No. 15/401,268 filed on Jan. 9, 2017 and claims the benefit of priority of Japanese Patent Application Number 2016-003942 filed on Jan. 12, 2016, the entire content of which is hereby incorporated by reference.

BACKGROUND

1. Technical Field

The present disclosure relates to a lighting apparatus which forms a mesh network with another lighting apparatus, and a lighting system.

2. Description of the Related Art

Conventionally, a lighting system is known in which lighting apparatuses having communications capabilities form a mesh network. The mesh network refers to a network in which the lighting apparatuses construct wireless communication paths therebetween.

As one lighting system of this kind, Japanese Unexamined Patent Application Publication No. 2014-60078 (Patent Literature 1) discloses a lighting system which includes lighting apparatuses each of which includes a wireless device, wireless terminals which communicate with the lighting apparatuses, and a management server which manages the lighting apparatuses. In the lighting system, adjacent lighting apparatuses are communicable with each other and the lighting apparatuses form a mesh network. In the lighting system, the lighting apparatuses are dimmed properly for a user who is holding one of the wireless terminals, based on location information of a user.

SUMMARY

In the lighting system disclosed in Patent Literature 1, the management server transmits a command for dimming a lighting apparatus via other lighting apparatuses, that is, using a communication path of the mesh network. However, a problem with the mesh network is that, for example, when a lighting apparatus is no longer participating in the mesh network for some reason, it is difficult for the mesh network to cause the lighting apparatus to re-participate in the mesh network. Moreover, it is difficult for the user to directly touch and repair a lighting apparatus promptly, due to the fact that the lighting apparatus is installed on the ceiling of a building or the temperature of the lighting apparatus has been increased through use.

Thus, the present disclosure provides a lighting apparatus, etc. which increase communication paths for the lighting apparatus to wirelessly communicate with another lighting apparatus, and allow the lighting apparatus to select a proper communication path according to need among the communication paths.

One aspect of the lighting apparatus according to the present disclosure includes: an apparatus communicator which wirelessly transmits and receives information on operation of the lighting apparatus; and an apparatus controller which interprets a mesh profile which is a communications protocol for the lighting apparatus to transmit and receive the information to and from another lighting apparatus and a communication terminal forming a mesh network, and a user profile which is a communications protocol for the lighting apparatus and the communication terminal to communicate with each other, the user profile being uniquely set for the lighting apparatus by the communication terminal, and executes a command corresponding to the mesh profile and received from the other lighting apparatus, and a command corresponding to the user profile and received from the communication terminal.

One aspect of a lighting system according to the present disclosure includes a plurality of the lighting apparatuses.

Communication paths for the lighting apparatus to wirelessly communicate with another lighting apparatus can be increased and the lighting apparatus is allowed to select a proper communication path according to need among the communication paths.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, a lighting apparatus and a lighting system according to embodiments of the present disclosure are described with reference to the accompanying drawings. The embodiments described below are each merely one specific example of the present disclosure. Thus, values, shapes, materials, components, and arrangement and connection between the components shown in the following embodiments are merely by way of illustration and not intended to limit the present disclosure. Therefore, among the components in the embodiments below, components not recited in any one of the independent claims defining the most generic part of the inventive concept of the present disclosure are described as arbitrary components.

The figures are schematic views and do not necessarily illustrate the present disclosure precisely. In the figures, the same reference sign is used to refer to substantially the same configuration, and thus duplicate description is omitted or simplified.

Embodiment 1

Figure 1:
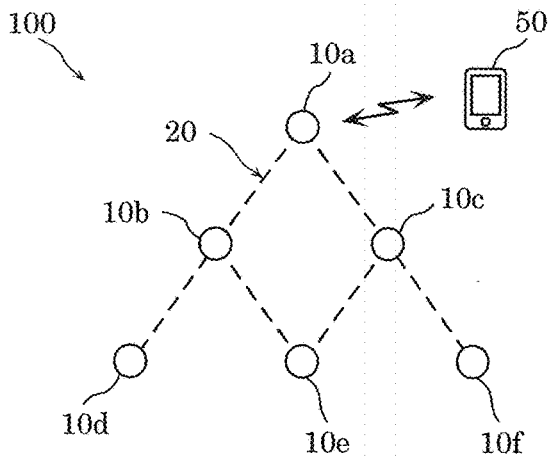
FIG. 1 is a diagram illustrating a lighting system and lighting apparatuses according to Embodiment 1, showing an example of a mesh network configured of the lighting apparatuses.

FIG. 1 is a diagram illustrating lighting system 100 and lighting apparatuses 10*a*, 10*b*, 10*c*, 10*d*, 10*e*, and 10*f* according to Embodiment 1, showing an example of mesh network 20 which includes lighting apparatuses 10*a* to 10*f*.

Lighting system 100 includes lighting apparatuses 10*a* to 10*f* having communications capabilities. In lighting system 100, adjacent lighting apparatuses (e.g., lighting apparatuses 10*c* and 10*f*), among lighting apparatuses 10*a* to 10*f*, communicate with each other to construct a wireless communication path therebetween and form mesh network 20. Lighting apparatuses 10*a* to 10*f* are also communicatively coupled with communication terminal 50 such as a tablet.

Figure 2:
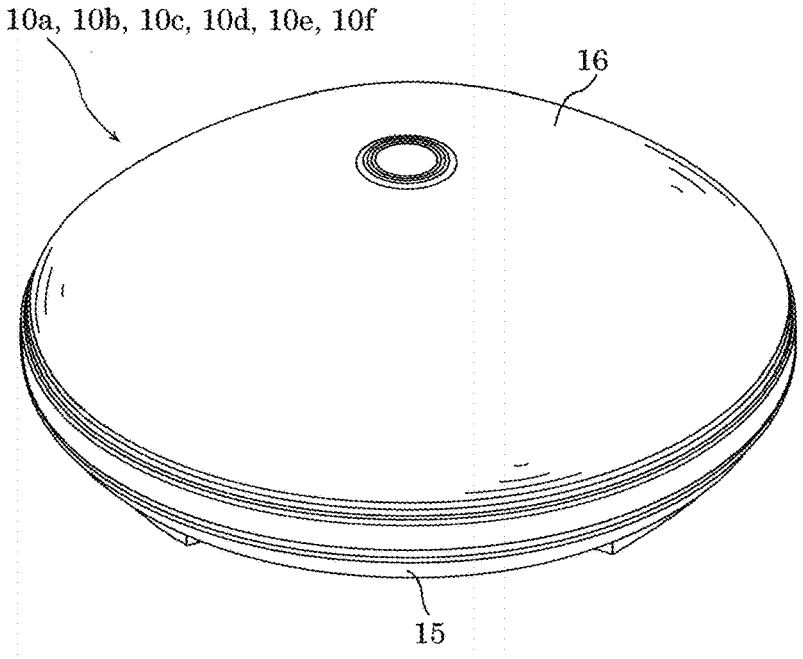
FIG. 2 is a diagram illustrating an example of the appearance of the lighting apparatuses according to Embodiment 1.
Figure 3:
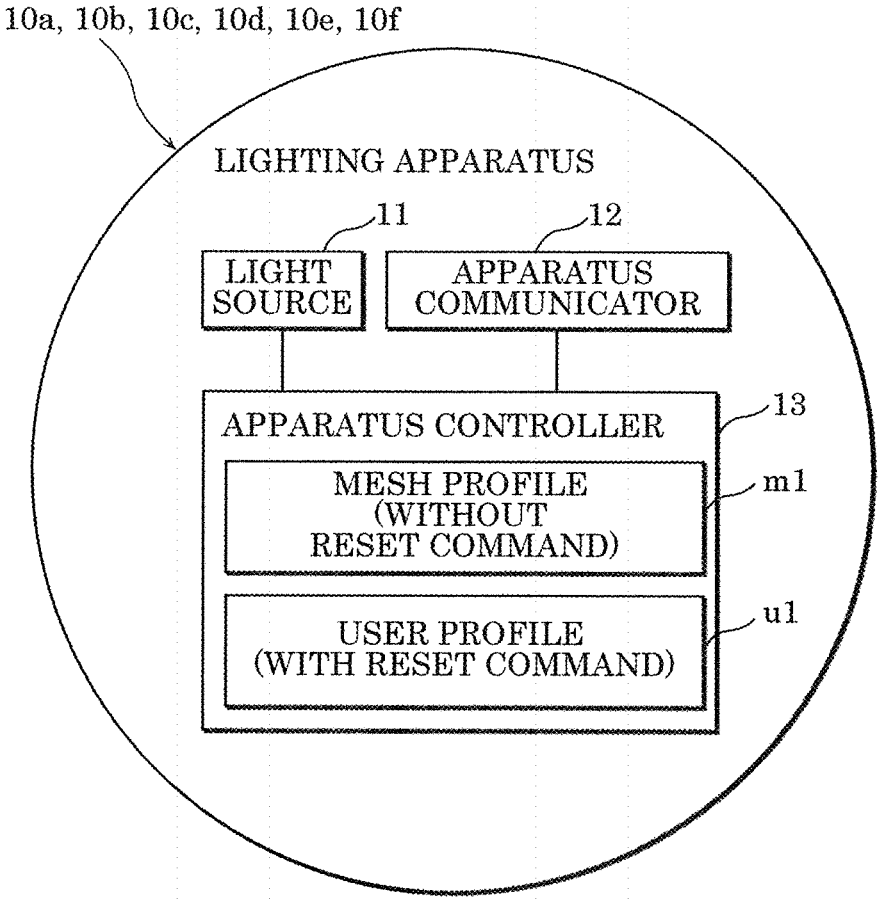
FIG. 3 is a block diagram illustrating a control configuration of the lighting apparatuses according to Embodiment 1.

FIG. 2 is a diagram illustrating an example of the appearance of each of lighting apparatuses 10*a* to 10*f*. FIG. 3 is a block diagram of a control configuration of each of lighting apparatuses 10*a* to 10*f*.

Lighting apparatuses 10*a* to 10*f* are, for example, ceiling lights as illustrated in FIG. 2, and installed in a building part (e.g., ceiling) of a building such as a house. Lighting apparatuses 10*a* to 10*f* each include apparatus body 15 and globe 16 which covers apparatus body 15. Globe 16 is formed of a light-transmissive resin material. Apparatus body 15, as illustrated in FIG. 3, includes light source 11, apparatus communicator 12, and apparatus controller 13.

Light source 11, for example, includes light-emitting diodes each of which emits white light, red light, green light, or blue light. Dimming and a color of the light emitted by light source 11 are controlled by apparatus controller 13.

Apparatus communicator 12 includes an antenna and a wireless communication circuit. Apparatus communicator 12 included in a lighting apparatus wirelessly transmits and receives information on operations of lighting apparatuses 10*a* to 10*f* to and from another lighting apparatus. For example, lighting apparatus 10*c* is communicable with lighting apparatuses 10*a*, 10*e*, and 10*f* located adjacent to lighting apparatus 10*c*. The communications are performed according to a communication scheme in which the communications are performed in 2.4-GHz frequency band, such as Bluetooth (registered trademark) specified in IEEE802.15.1 standard. Apparatus communicators 12 included in lighting apparatuses 10*a* to 10*f* are communicable with communication terminal 50 as well.

Apparatus controller 13 includes, for example, a CPU, a RAM, and a ROM storing a program. In the present embodiment, apparatus controller 13 has mesh profile m1 and user profile u1. Mesh profiles m1 are communications protocols for lighting apparatuses 10*a* to 10*f* to transmit and receive signals to and from another lighting apparatus and communication terminal 50. Lighting apparatuses 10*a* to 10*f* form mesh network 20. User profiles u1 are communications protocols for lighting apparatuses 10*a* to 10*f* and communication terminal 50 to communicate with each other. User profile u1 is uniquely set for each lighting apparatus by communication terminal 50.

Mesh profile m1 includes authentication information including an address assigned for each of lighting apparatuses 10*a* to 10*f* and a cryptographic key for the network. In apparatus controller 13, the authentication information including the address and cryptographic key is deletable or modifiable.

Mesh profiles m1 also include commands for controlling operations of lighting apparatuses 10*a* to 10*f*, the operations including the dimming, color controlling, scenes, and schedules of light sources 11 included in lighting apparatuses 10*a* to 10*f*. Lighting apparatuses 10*a* to 10*f* are each operated according to a command corresponding to mesh profile m1. The command corresponding to mesh profile m1 is transmitted from communication terminal 50 via a communication path of mesh network 20. For example, lighting apparatus 10*a* receives, by apparatus communicator 12, the command corresponding to mesh profile m1 and transmitted from communication terminal 50, and causes apparatus controller 13 to execute the command corresponding to mesh profile m1. At the same time, lighting apparatus 10*a* causes apparatus communicator 12 to transmit to lighting apparatuses 10*b* and 10*c* located adjacent to lighting apparatus 10*a*, the command corresponding to mesh profile m1 that has been transmitted to lighting apparatus 10*a*.

It should be noted that lighting apparatuses 10*a* to 10*f* according to the present embodiment each receive not only the information but also a command corresponding to user profile u1 and transmitted from communication terminal 50 via the communication path of mesh network 20. Lighting apparatus 10*a* to 10*f* each cause apparatus controller 13 to execute the command corresponding to user profile u1 and received by apparatus communicator 12.

For example, the commands corresponding to user profiles u1 include reset commands which initialize configurations of lighting apparatuses 10*a* to 10*f* to cause lighting apparatuses 10*a* to 10*f* to be ready to participate in mesh network 20.

In contrast, the commands corresponding to mesh profiles m1 do not include the reset commands which initialize the configurations of lighting apparatuses 10*a* to 10*f* to cause lighting apparatuses 10*a* to 10*f* to be ready to participate in mesh network 20. For that reason, lighting apparatuses 10*a* to 10*f* can be reset directly by communication terminal 50 by using user profiles u1, but are not reset indirectly by using mesh profiles m1. This reduces chances of inadvertent resetting of lighting apparatuses 10*a* to 10*f*.

Figure 4:
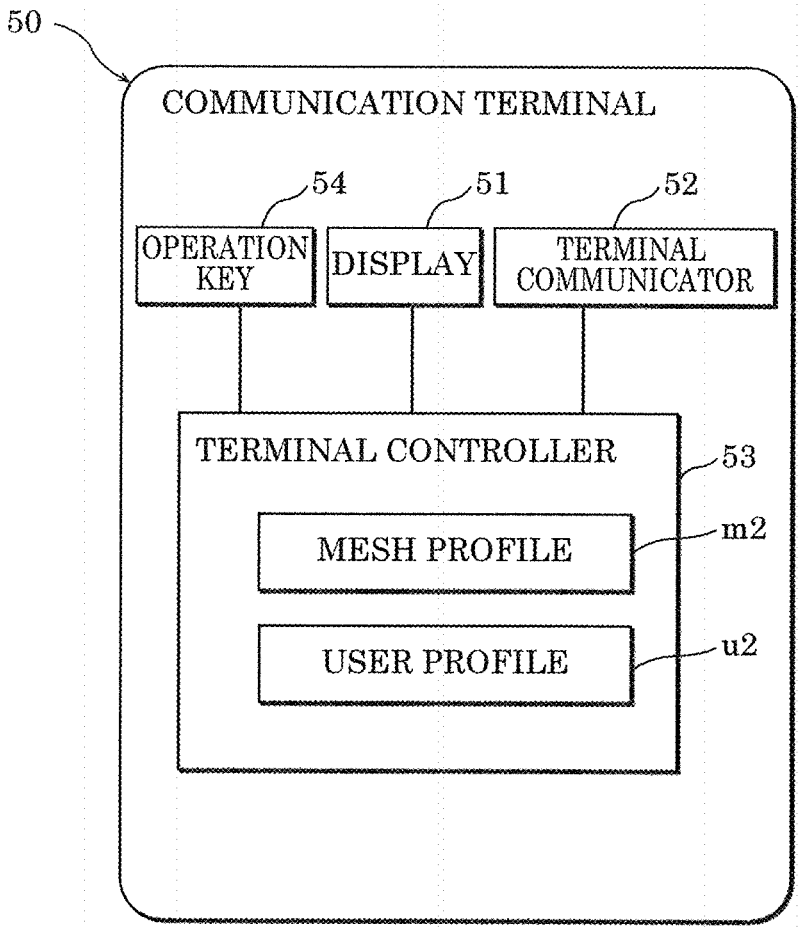
FIG. 4 is a block diagram of a control configuration of a communication terminal which communicates with the lighting apparatuses according to Embodiment 1.

FIG. 4 is a block diagram of a control configuration of communication terminal 50 which communicates with lighting apparatuses 10*a* to 10*f*.

Communication terminal 50 includes operation key 54, display 51, terminal communicator 52, and terminal controller 53.

Operation key 54 is, for example, a touch panel for selecting or inputting commands for operating lighting apparatuses 10*a* to 10*f*. Display 51 is, for example, a liquid crystal monitor for displaying states of individual lighting apparatuses 10*a* to 10*f* and as to whether they are participating or not participating in mesh network 20.

Terminal communicator 52 includes an antenna and a wireless communication circuit. Terminal communicator 52 is communicable with lighting apparatuses 10*a* to 10*f* that are within a predetermined distance. Terminal communicator 52 communicates with lighting apparatuses 10*a* to 10*f* at a frequency different from the frequency of mesh network 20, using a communication scheme which is, for example, Bluetooth (registered trademark).

Terminal controller 53 includes, for example, a CPU, a RAM, and a ROM. Terminal controller 53 has mesh profile m2 and user profile u2. Mesh profile m2 is a communications protocol and has functionality common to mesh profiles m1 of lighting apparatuses 10*a* to 10*f*. User profile u2 is a communications protocol and has functionality common to user profiles u1 of lighting apparatuses 10*a* to 10*f*.

Mesh profile m2 includes authentication information including an address assigned for each of lighting apparatuses 10*a* to 10*f* and a cryptographic key for the network. The authentication information including the address and cryptographic key can be input via operation key 54. Mesh profile m2 also includes commands for controlling operations of lighting apparatuses 10*a* to 10*f*, the operations including the dimming, color controlling, scenes, and schedules of light sources 11 included in lighting apparatuses 10*a* to 10*f*. Communication terminal 50 can operate individual lighting apparatuses 10*a* to 10*f*, based on the commands included in mesh profile m2.

The commands corresponding to user profiles u2 include reset commands which initialize configurations of individual lighting apparatuses 10*a* to 10*f* to cause lighting apparatuses 10*a* to 10*f* to be ready to participate in mesh network 20.

Figure 5:
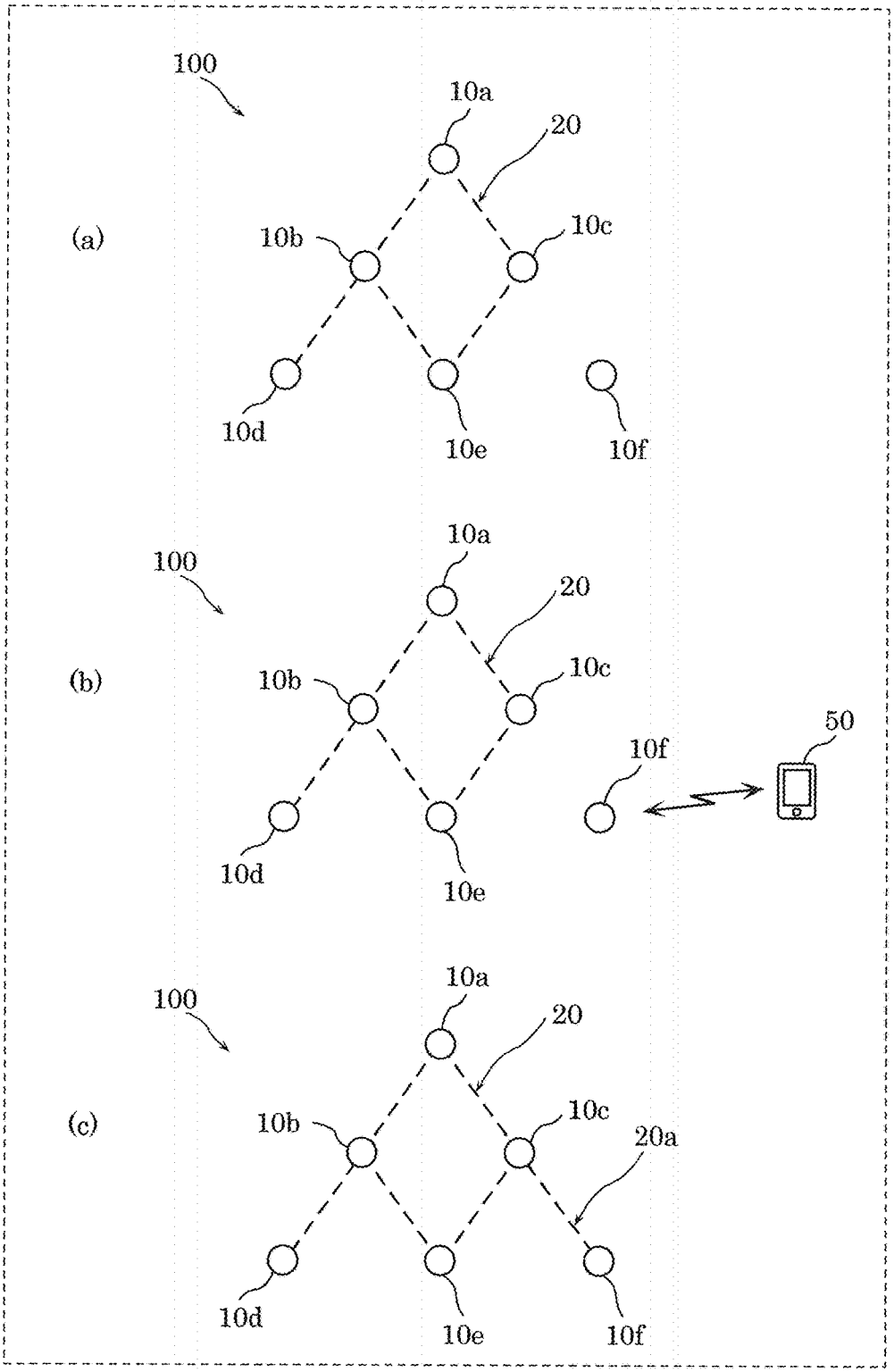
FIG. 5 is a diagram illustrating a relationship between the mesh network and the lighting apparatuses according to Embodiment 1, showing (a) a state in which a certain lighting apparatus is not participating in the mesh network, (b) a state in which the lighting apparatus not participated in the mesh network is communicating with the communication terminal, and (c) a state in which the lighting apparatus has re-participated in the mesh network.
Figure 6:
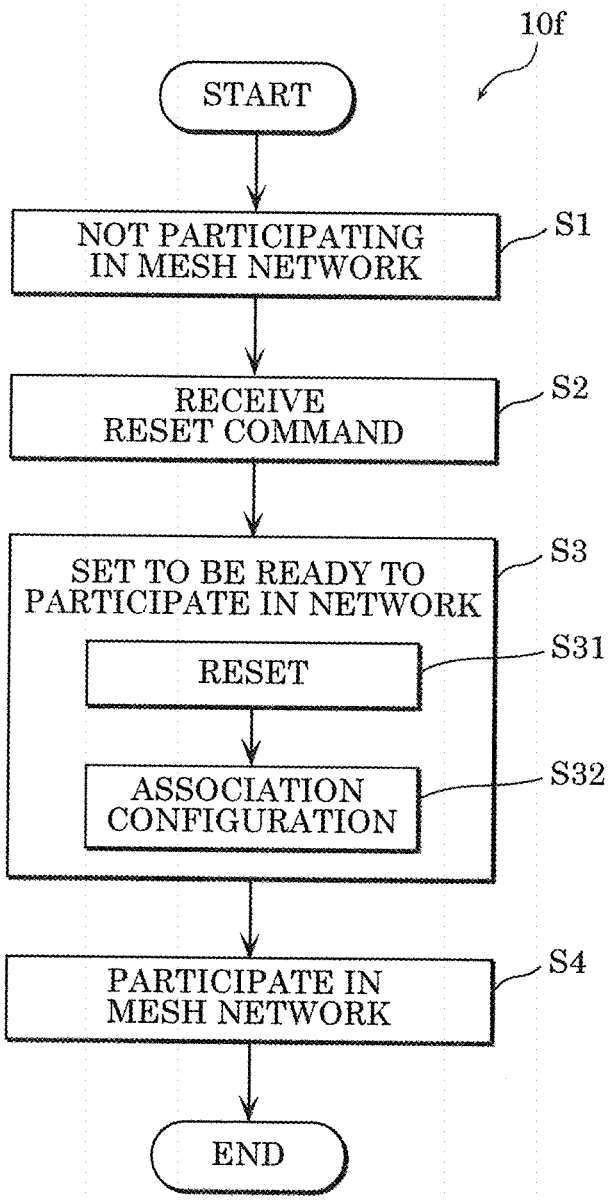
FIG. 6 is a flowchart illustrating a manner of causing the lighting apparatus not participating in the mesh network to participate in the mesh network.

Next, referring to FIGS. 5 and 6, a method for causing lighting apparatus 10*f* not participating in mesh network 20 to re-participate in mesh network 20 is described.

FIG. 5 illustrates (a) a state in which lighting apparatus 10*f* is not participating in mesh network 20, (b) a state in which lighting apparatus 10*f* not participated in mesh network 20 is communicating with communication terminal 50, and (c) a state in which lighting apparatus 10*f* has re-participated in mesh network 20. FIG. 6 is a flowchart illustrating a manner of causing lighting apparatus 10*f* not participating in mesh network 20 to participate in mesh network 20.

As illustrated in (a) of FIG. 5, if the cryptographic key of lighting apparatus 10*f* among lighting apparatuses 10*a* to 10*f* is unintentionally modified for some reason, lighting apparatus 10*f* may end up not participating in mesh network 20 and thus no longer form part of mesh network 20 (51 of FIG. 6). Since lighting apparatus 10*f* is already disconnected from mesh network 20, even though lighting apparatus 10*f* is desired to participate in mesh network 20, mesh network 20 itself cannot restore the communication path for lighting apparatus 10*f* to cause lighting apparatus 10*f* to participate in mesh network 20.

Thus, as illustrated in (b) of FIG. 5, lighting apparatus 10*f* is caused to participate in mesh network 20 through a communication path between communication terminal 50 and lighting apparatus 10*f*. Initially, communication terminal 50 transmits to lighting apparatus 10*f* the reset command corresponding to user profile u1. This results in lighting apparatus 10*f* receiving the reset command (S2 of FIG. 6).

Lighting apparatus 10*f* having received the reset command sets the configuration of lighting apparatus 10*f* to be ready to participate in the network (S3 of FIG. 6). Specifically, initially, the current configuration of lighting apparatus 10*f* is reset (initialized) (S31 of FIG. 6). The resetting deletes the information on the operation of lighting apparatus 10*f*, and the authentication information, including the address and cryptographic key, which is stored in apparatus controller 13 included in lighting apparatus 10*f*.

Next, association configuration (configuration to participate in mesh network 20) is carried out on lighting apparatus 10*f* having been reset (S32 of FIG. 6). Specifically, apparatus communicator 12 included in lighting apparatus 10*f* sends out a beacon for externally notifying that lighting apparatus 10*f* needs association configuration. It should be noted that lighting apparatus 10*f* is in a full-on state while sending out the beacon.

When communication terminal 50 receives the beacon sent out from lighting apparatus 10*f*, communication terminal 50 displays, on display 51, an indication indicating that lighting apparatus 10*f* is requesting for association configuration, and obtains, from the beacon, a unique device identifier (UDID) of lighting apparatus 10*f*. Communication terminal 50 then performs a predetermined operation, and thereby transmits to lighting apparatus 10*f* the authentication information (such as an address and a cryptographic key) for causing lighting apparatus 10*f* to participate in mesh network 20, using the command corresponding to user profile u2. The authentication information is associated with the UDID.

Lighting apparatus 10*f* having received the authentication information executes the command corresponding to user profile u1, the authentication information including the address and cryptographic key is written to apparatus controller 13. This restores the configuration of lighting apparatus 10*f* to the default state which is a configuration state of lighting apparatus 10*f* when previously participated in mesh network 20. Lighting apparatus 10*f* restored to the default state ceases from sending out the beacon.

Then, as illustrated in (c) of FIG. 5, communication path 20*a* is formed between lighting apparatus 10*f* and lighting apparatus 10*c* adjacent to lighting apparatus 10*f*, and lighting apparatus 10*f* participates in mesh network 20 (S4 FIG. 6). Lighting apparatus 10*f* participating in mesh network 20 is operated and controlled, using the command corresponding to mesh profile m1.

As described above, lighting apparatuses 10*a* to 10*f* according to the present embodiment each include: apparatus communicator 12 which wirelessly transmits and receives information on operations of lighting apparatuses 10*a* to 10*f*; and apparatus controller 13 which has: mesh profile m1 which is a communications protocol for lighting apparatuses 10*a* to 10*f* to transmit and receive the information to and from another lighting apparatus and communication terminal 50, each of lighting apparatuses 10*a* to 10*f* and the other lighting apparatus forming mesh network 20; and user profile u1 which is a communications protocol for each of lighting apparatuses 10*a* to 10*f* and communication terminal 50 to communicate with each other, user profile u1 being uniquely set for each of lighting apparatuses 10*a* to 10*f* by communication terminal 50. Apparatus controller 13 executes a command corresponding to mesh profile m1 and received from the other lighting apparatus, and a command corresponding to user profile u1 and received from communication terminal 50.

According to the above configuration, in order to operate a certain lighting apparatus (e.g., lighting apparatus 10*f*), options are selectable between either operating the lighting apparatus by using mesh profile m1 common to mesh profiles m1 of the other lighting apparatuses (e.g., lighting apparatuses 10*a* to 10*e*) or operating the lighting apparatus by using user profile u1 common to user profile u2 included in communication terminal 50. This allows a proper communication path to be selected according to need for wireless communications with lighting apparatuses 10*a* to 10*f*. Moreover, even when lighting apparatuses 10*a* to 10*f* are installed on the ceiling of a building or the temperatures thereof have been increased through use, lighting apparatuses 10*a* to 10*f* can be restored to the default states via wireless communications.

Moreover, the commands corresponding to user profiles u1 may include reset commands for initializing configurations of lighting apparatuses 10*a* to 10*f* to cause lighting apparatuses 10*a* to 10*f* to be ready to participate in mesh network 20, and the command corresponding to mesh profile m1 may not include the reset command.

According to the above configuration, when resetting the certain lighting apparatus (e.g., lighting apparatus 10*f*), the other lighting apparatuses (e.g., lighting apparatuses 10*a* to 10*e*) are not reset through communication paths of mesh network 20. This results in reducing chances of inadvertent resetting of the other lighting apparatuses.

Moreover, when lighting apparatus 10*f* is disconnected from and no longer forming part of mesh network 20 with the other lighting apparatus, apparatus controller 13 may cause lighting apparatus 10*f* no longer forming part of mesh network 20 to participate in mesh network 20 by using the command corresponding to user profile u1.

This allows directly restoring the lighting apparatus (e.g., lighting apparatus 10*f*) disconnected from mesh network 20 to the default state by using communication terminal 50 having user profile u2, and causing the lighting apparatus to re-participate in mesh network 20.

Moreover, lighting system 100 according to the present embodiment includes lighting apparatuses 10*a* to 10*f*.

According to the above configuration, in order to operate a certain lighting apparatus (e.g., lighting apparatus 10*f*) included in lighting system 100, options are selectable between either operating the lighting apparatus by using mesh profile m1 common to the other lighting apparatuses (e.g., lighting apparatuses 10*a* to 10*e*) or operating the lighting apparatus by using user profile u1 common to communication terminal 50. This allows a proper communication path to be selected according to need for wireless communications with lighting apparatuses 10*a* to 10*f* included in lighting system 100.

Embodiment 2

Lighting apparatuses 30*a*, 30*b*, 30*c*, 30*d*, 30*e*, and 30*f* (FIG. 7) according to Embodiment 2 are each given a command from another lighting apparatus through a communication path of mesh network 20, rather than being given the command directly from communication terminal 50.

Figure 8:
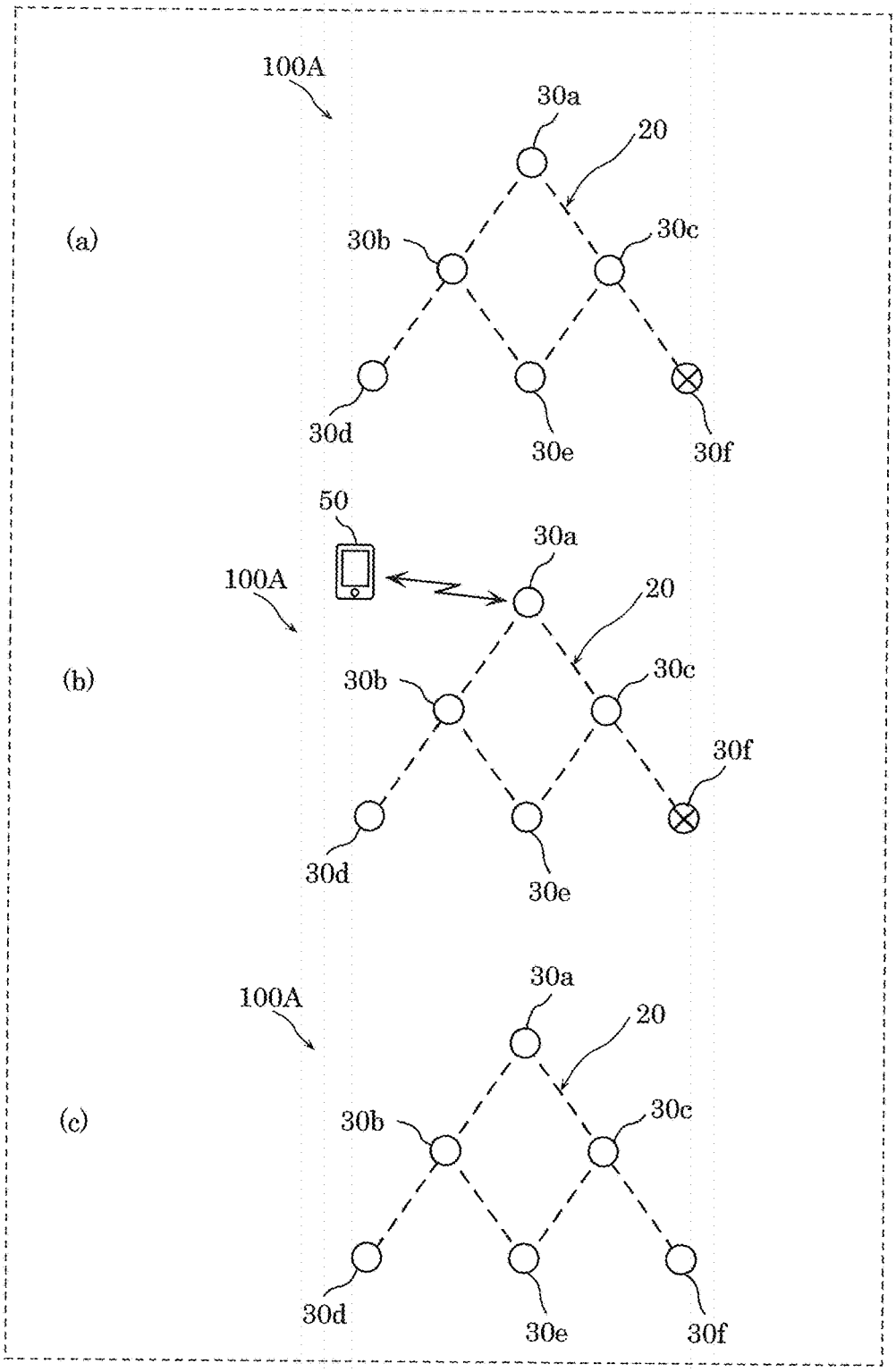
FIG. 8 is a diagram illustrating relationship between a mesh network and the lighting apparatuses according to Embodiment 2, showing (a) a state in which a certain lighting apparatus is participating in the mesh network, (b) a state in which the lighting apparatus is reset through communication paths of the mesh network, and (c) a relationship between the mesh network and the lighting apparatus restored to a default state.

Lighting system 100A according to Embodiment 2 includes lighting apparatuses 30*a* to 30*f* which have communications capabilities (see (a) of FIG. 8). In lighting system 100A, adjacent lighting apparatuses (e.g., lighting apparatuses 30*b* and 30*d*), among lighting apparatuses 30*a* to 30*f*, communicate with each other to construct a wireless communication path therebetween and form mesh network 20. Lighting apparatuses 30*a* to 30*f* are also communicatively coupled with communication terminal 50 such as a tablet.

Figure 7:
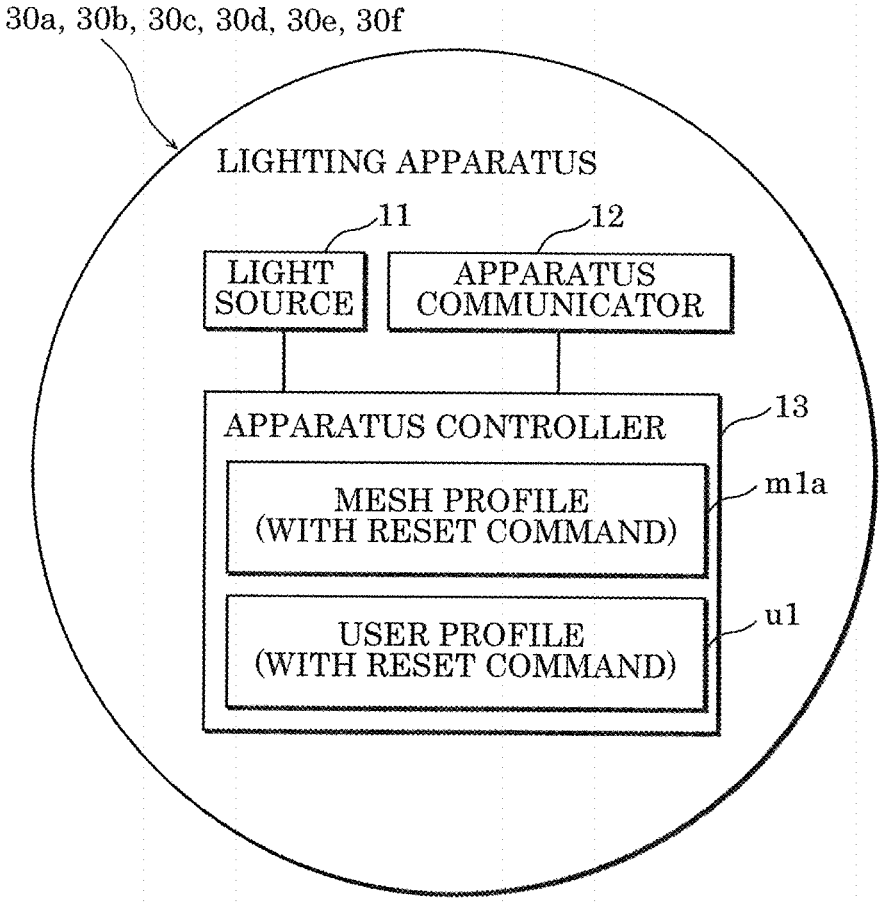
FIG. 7 is a block diagram of a control configuration of lighting apparatuses according to Embodiment 2.

FIG. 7 is a block diagram of a control configuration of lighting apparatuses 30*a* to 30*f*.

Lighting apparatuses 30*a* to 30*f* each include light source 11, apparatus communicator 12, and apparatus controller 13.

Apparatus controller 13 has mesh profile m1*a* and user profile u1. Mesh profiles m1*a* are communications protocols for lighting apparatuses 30*a* to 30*f* to transmit and receive signals to and from communication terminal 50. Lighting apparatuses 30*a* to 30*f* form mesh network 20. User profiles u1 are communications protocols for lighting apparatuses 30*a* to 30*f* and communication terminal 50 to communicate with each other. User profile u1 is uniquely set for each lighting apparatus by communication terminal 50.

Mesh profiles m1*a* include authentication information including addresses assigned for lighting apparatuses 30*a* to 30*f* and a cryptographic key for the network.

Mesh profiles m1*a* also include commands for controlling operations of lighting apparatuses 30*a* to 30*f*, the operations including the dimming, color controlling, scenes, and schedules of light sources 11 included in lighting apparatuses 30*a* to 30*f*. Lighting apparatuses 30*a* to 30*f* are each operated according to a command corresponding to mesh profile m1*a*. The command corresponding to mesh profile m1*a* is transmitted from communication terminal 50 via a communication path of mesh network 20.

Lighting apparatuses 30*a* to 30*f* according to the present embodiment have commands corresponding to mesh profiles m1*a* and commands corresponding to user profiles u1, the commands corresponding to mesh profiles m1*a* and the commands corresponding to user profiles u1 including reset commands which set the configurations of lighting apparatuses 30*a* to 30*f* to default states. It should be noted that the default state refers to a configuration state for each of lighting apparatuses 30*a* to 30*f* when previously participated in mesh network 20.

Similar to as shown in FIG. 4, communication terminal 50 includes operation key 54, display 51, terminal communicator 52, and terminal controller 53.

Terminal controller 53 has mesh profile m2 and user profile u2. Mesh profile m2 is a communications protocol and has functionality common to mesh profiles m1*a* of lighting apparatuses 30*a* to 30*f*. User profile u2 is a communications protocol and has functionality common to user profiles u1 of lighting apparatuses 30*a* to 30*f*. To be more specific, commands corresponding to mesh profiles m2 and user profiles u2 include the reset commands which set the configurations of lighting apparatuses 30*a* to 30*f* to the default states.

Lighting apparatuses 30*a* to 30*f* according to the present embodiment each receive, by apparatus communicator 12, not only the information but also a command corresponding to user profile u1 via the communication path of mesh network 20. The command corresponding to user profile u1 is transmitted from communication terminal 50. Lighting apparatus 10*a* to 10*f* each cause apparatus controller 13 to execute the command corresponding to user profile u1.

In the present embodiment, however, not only the commands corresponding to user profiles u1 but also the commands corresponding to mesh profiles m1*a* include the reset commands which set the configurations of lighting apparatuses 30*a* to 30*f* to the default states. For that reason, for example, by transmitting the reset command to nearby lighting apparatus 30*a*, communication terminal 50 can set distant lighting apparatus 30*f* to the default state using the reset command included in mesh profile m1*a* included in lighting apparatus 30*f*.

Next, referring to FIG. 8, a method for resetting lighting apparatus 30*f* participating in mesh network 20 is described.

FIG. 8 illustrates (a) a state in which lighting apparatus 30*f* is participating in mesh network 20, (b) a state in which lighting apparatus 30*f* is reset through communication paths of mesh network 20, and (c) a relationship between mesh network 20 and lighting apparatus 30*f* restored to the default state.

As illustrated (a) of FIG. 8, lighting apparatus 30*f* among lighting apparatuses 30*a* to 30*f* may, for some reason, perform an operation unintended by a user. "Operation unintended by a user," as used herein, refers to a case, for example, where the light of lighting apparatus 30*a* is different in intensity or color from those of lighting apparatuses 30*a* to 30*e*. If lighting apparatus 30*f* is near communication terminal 50, lighting apparatus 30*f* can be reset to be restored to the default state directly by using communication terminal 50 as described above in relation to Embodiment 1. If lighting apparatus 30*f* is distant from communication terminal 50, the user needs to move communication terminal 50 to a location close to lighting apparatus 30*f*. This is laborious and time-consuming.

Thus, as illustrated in (b) of FIG. 8, lighting apparatus 30*f* is reset to the default state, using a communication path of mesh network 20. Initially, communication terminal 50 transmits the reset command included in mesh profile m1*a* to lighting apparatus 30*a*. The reset command is transferred to lighting apparatus 30*f* via lighting apparatus 30*a* and lighting apparatus 30*c* forming mesh network 20. To be more specific, lighting apparatus 30*f* receives the reset command included in mesh profile m1*a* via lighting apparatuses 30*a* and 30*c* that are different from lighting apparatus 30*f*.

Lighting apparatus 30*f* having received the reset command sets the configuration of lighting apparatus 30*f* to the default state. Specifically, the current configuration (dimming, color controlling, etc.) of lighting apparatus 30*f* is set to the default state. It should be noted that the address and cryptographic key stored in apparatus controller 13 included in lighting apparatus 30*f* are retained without being deleted.

This allows the operation of lighting apparatus 30*f* restored to the default state to be controlled again, as with lighting apparatuses 30*a* to 30*e*, using the command corresponding to mesh profile m1*a* as illustrated in (c) of FIG. 8.

It should be noted that in order to reset lighting apparatus 30*f*, the address and cryptographic key stored in apparatus controller 13 included in lighting apparatus 30*f* may be deleted. Even after the address and cryptographic key are deleted, communication terminal 50 can restore lighting apparatuses 30*a* to 30*f* to the default states by associating with lighting apparatuses 30*a* to 30*f* through exchanging public keys and thereafter assigning lighting apparatuses 30*a* to 30*f* with addresses and cryptographic keys. Moreover, as with S32 in FIG. 6 in Embodiment 1, the association configuration can be carried out on lighting apparatus 30*f*, using user profile u2 of communication terminal 50.

As described above, lighting apparatuses 30*a* to 30*f* according to the present embodiment each include: apparatus communicator 12 which wirelessly transmits and receives information on operations of lighting apparatuses 30*a* to 30*f*; and apparatus controller 13 which has: mesh profile m1*a* which is a communications protocol for lighting apparatuses 30*a* to 10 to transmit and receive the information to and from another lighting apparatus and communication terminal 50, each of lighting apparatuses 30*a* to 10 and the other lighting apparatus forming mesh network 20; and user profile u1 which is a communications protocol for each of lighting apparatuses 30*a* to 30*f* and communication terminal 50 to communicate with each other, user profile u1 being uniquely set for each of lighting apparatuses 30*a* to 30*f* by communication terminal 50. Apparatus controller 13 executes a command corresponding to mesh profile m1*a* and received from the other lighting apparatus, and a command corresponding to user profile u1 and received from communication terminal 50.

According to the above configuration, in order to operate a certain lighting apparatus (e.g., lighting apparatus 30*f*), options are selectable between operating the lighting apparatus by using mesh profile m1*a* common to mesh profiles m1 of the other lighting apparatuses (e.g., lighting apparatuses 30*a* to 30*e*) or operating the lighting apparatus by using user profile u1 common to communication terminal 50. This allows a proper communication path to be selected according to need for wireless communications with lighting apparatuses 30*a* to 30*f*. Moreover, even when lighting apparatuses 30*a* to 30*f* are installed on the ceiling of a building or the temperatures thereof have been increased through use, lighting apparatuses 30*a* to 30*f* can be restored to the default states via wireless communications.

Moreover, the command corresponding to mesh profile m1*a* and the command corresponding to user profile u1 may include reset commands for changing configurations of lighting apparatuses 30*a* to 30*f* to the default states.

According to the above configuration, the certain lighting apparatus (e.g., lighting apparatus 30*f*) can be reset not only by using the command corresponding to user profile u1, but also by using the command corresponding to mesh profile m1*a*, thereby allowing an increase in options for resetting lighting apparatuses 30*a* to 30*f*.

Moreover, apparatus communicator 12 may receive from the other lighting apparatus the reset command corresponding to mesh profile m1*a*, and apparatus controller 13 may execute the reset command corresponding to mesh profile m1*a*.

According to this configuration, for example, distant lighting apparatus 30*f* can be restored to the default state using the reset command corresponding to mesh profile m1*a* included in lighting apparatus 30*f*, by transmitting the reset command to lighting apparatus 30*a*.

While the present embodiment has been described with reference to restoring lighting apparatus 30*f* to the default states with reference to FIG. 8, the present embodiment is not limited thereto. For example, the present disclosure may be used to restore lighting apparatus 30*a* to the default state when lighting apparatus 30*a* participating in mesh network 20 does not conform with lighting apparatuses 30*b* to 30*f* in terms of dimming or color controlling.

While lighting apparatuses 10*a* to 10*f*, 30*a* to 30*f* and lighting system 100, 100A have been described with reference to the embodiments, the present disclosure is not limited to the above embodiments. For example, various modifications to the embodiments according to the present disclosure described above that may be conceived by a person skilled in the art and embodiments implemented by any combination of the components and functions shown in the above embodiments are also included within the scope of the present disclosure, without departing from the spirit of the present disclosure.

For example, while lighting apparatuses 10*a* to 10*f* are operated by commands included in communication terminal 50 in Embodiment 1, the present disclosure is not limited thereto. Lighting system 100 may include a management server which manages lighting apparatuses 10*a* to 10*f* and the management server may operate lighting apparatuses 10*a* to 10*f* by commands corresponding to a mesh profile of the management server.

Moreover, while mesh profile m2 of terminal controller 53 does not include the reset command in Embodiment 1, the present disclosure is not limited thereto. Mesh profile m2 of terminal controller 53 may include the reset command. Since the reset commands corresponding to mesh profiles m1 are not executed in lighting apparatuses 10*a* to 10*f* in Embodiment 1, there is no problem with transmitting the reset command according to mesh profile m2 of terminal controller 53.

Moreover, while Embodiment 1 has been described with reference to a mesh network being formed of adjacent lighting apparatuses (e.g., lighting apparatuses 10*c* and 100, the present disclosure is not limited thereto. The mesh network may be formed between lighting apparatuses 10*a* to 10*f* equivalent to a predetermined number of hops within the range of wirelessly communication.

Moreover, while Embodiments 1 and 2 have been described with reference to Bluetooth (registered trademark) as the communication scheme, the present disclosure is not limited thereto. A communication scheme such as WiFi (registered trademark), infrared communications, Wi-SUN, or Zigbee may be used.

Moreover, while Embodiment 1 has been described with reference to lighting apparatuses 10*a* to 10*f* being ceiling lights, the present disclosure is not limited thereto. Lighting apparatuses 10*a* to 10*f* may be LED base lights or LED down lights, or other types of lighting without departing from the intended scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus comprising:

an apparatus communicator which wirelessly transmits and receives information on operation of the lighting apparatus; and an apparatus controller which interprets a mesh profile which is a communications protocol for the lighting apparatus to transmit and receive the information to and from another lighting apparatus and a communication terminal forming a mesh network, and a user profile which is a communications protocol for the lighting apparatus and the communication terminal to communicate with each other, the user profile being set depending on the communication terminal, and executes a command corresponding to the mesh profile and received from the other lighting apparatus, and a command corresponding to the user profile and received from the communication terminal, wherein the command corresponding to the mesh profile and the command corresponding to the user profile include a reset command for changing a configuration of the lighting apparatus to a default state, wherein the reset command, when executed, retains and does not delete an address or cryptographic key stored in the apparatus controller.

2. The lighting apparatus according to claim 1, wherein the apparatus communicator receives from the other lighting apparatus the reset command corresponding to the mesh profile, and the apparatus controller executes the reset command corresponding to the mesh profile.

3. A lighting system comprising a plurality of the lighting apparatuses, each including:

an apparatus communicator which wirelessly transmits and receives information on operation of the lighting apparatus; and an apparatus controller which interprets a mesh profile which is a communications protocol for the lighting apparatus to transmit and receive the information to and from another lighting apparatus among the plurality of lighting apparatuses and a communication terminal forming a mesh network, and a user profile which is a communications protocol for the lighting apparatus and the communication terminal to communicate with each other, the user profile set depending on the communication terminal, and executes a command corresponding to the mesh profile and received from the other lighting apparatus, and a command corresponding to the user profile and received from the communication terminal, wherein the command corresponding to the mesh profile and the command corresponding to the user profile include a reset command for changing a configuration of the lighting apparatus to a default state, wherein the reset command, when executed, retains and does not delete an address or cryptographic key stored in the apparatus controller.

4. The lighting system according to claim 3, wherein the apparatus communicator receives from the other lighting apparatus the reset command corresponding to the mesh profile, and the apparatus controller executes the reset command corresponding to the mesh profile.

* * * * *